United States Patent [19]

Schloemann

[11] 4,003,830

[45] Jan. 18, 1977

[54] NON-FERROMAGNETIC MATERIALS SEPARATOR

[75] Inventor: Ernst F. R. A. Schloemann, Weston, Mass.

[73] Assignee: Raytheon Company, Lexington, Mass.

[22] Filed: Feb. 24, 1975

[21] Appl. No.: 552,576

Related U.S. Application Data

[63] Continuation-in-part of Ser. No. 509,203, Sept. 25, 1974, abandoned.

[52] U.S. Cl. ..... 209/3; 209/212; 209/223 R; 209/216

[51] Int. Cl.[2] ..... B03B 1/00

[58] Field of Search ..... 209/223, 3, 212–215, 209/216; 210/222, 223

[56] References Cited

UNITED STATES PATENTS

| | | | |
|---|---|---|---|
| 225,029 | 3/1880 | Thayer | 209/223 R |
| 262,790 | 8/1882 | King | 209/223 R |
| 278,976 | 6/1883 | Viger | 209/231 |
| 695,080 | 3/1902 | Ramspeck | 209/215 X |
| 823,301 | 6/1906 | Snyder | 209/223 R |
| 871,365 | 11/1907 | Schwarz | 209/223 R |
| 1,145,046 | 7/1915 | Weatherby | 209/478 |
| 1,463,713 | 7/1923 | Mordey | 209/227 |
| 2,186,863 | 1/1950 | Gottfried | 194/101 |
| 2,645,745 | 7/1953 | Moreton | 209/223 R |
| 2,904,178 | 9/1959 | Wintermute | 209/232 X |
| 3,824,516 | 7/1974 | Benowitz | 209/212 X |

FOREIGN PATENTS OR APPLICATIONS

| | | | |
|---|---|---|---|
| 157,037 | 4/1902 | Germany | 209/40 |

OTHER PUBLICATIONS

Electromag. Sep. of Al & Non Ferrous Metals, Campbell, 103'd, AIME Meeting, Dallas, Texas, Feb. 1974.

*Primary Examiner*—Robert Halper
*Attorney, Agent, or Firm*—Harold A. Murphy; Joseph D. Pannone; John T. Meaney

[57] ABSTRACT

A materials separator for segregating nonferromagnetic conductors from commingled nonferromagnetic materials, the separator including guide means for directing nonferromagnetic materials into a stream, and steady-state magnetic means comprising a plurality of north and south magnetic poles arranged in stripes of alternating polarity at a substantially uniform angle to the stream for establishing in the path of the stream a periodic series of oppositely directed, static magnetic fields which induce eddy-currents in the conductors.

28 Claims, 9 Drawing Figures

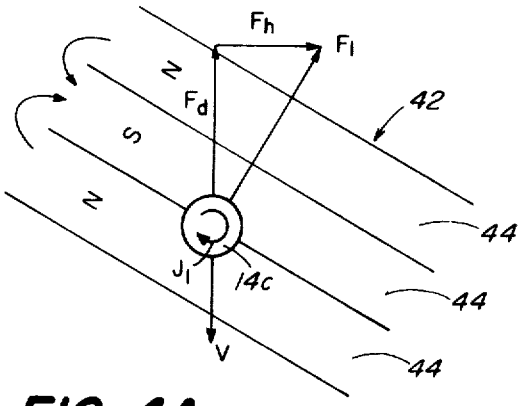
FIG. 4A
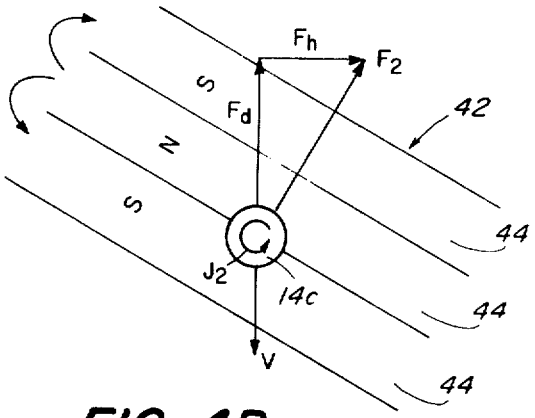
FIG. 4B
FIG. 4C
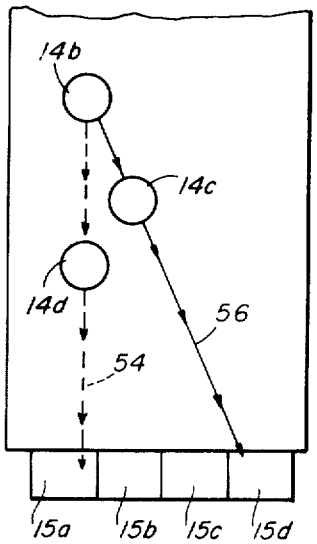
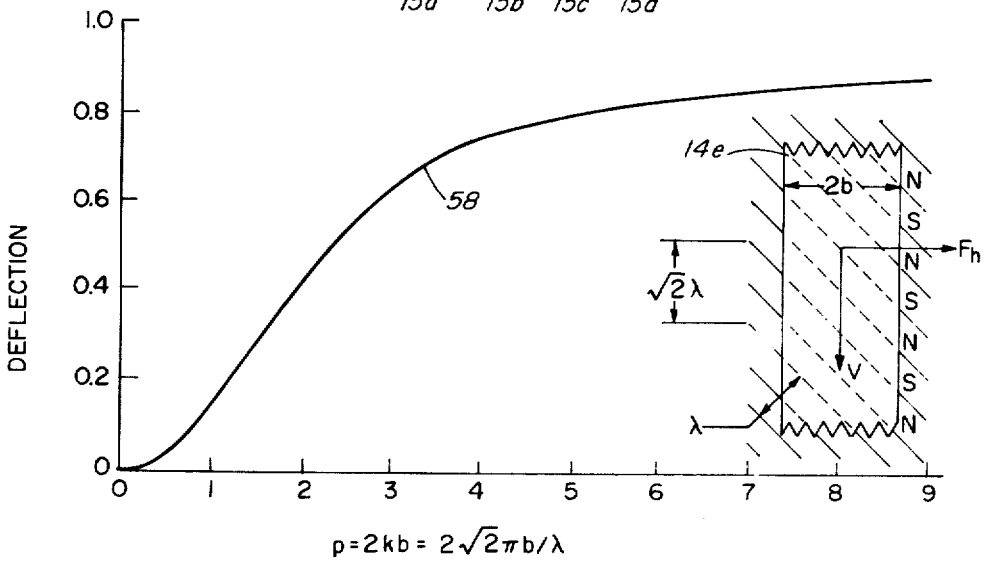
FIG. 5

NON-FERROMAGNETIC MATERIALS SEPARATOR

CROSS-REFERENCE TO RELATED APPLICATION

This is a continuation-in-part of application Ser. No. 509,203 now abandoned filed on Sept. 25, 1974.

BACKGROUND OF THE INVENTION

This invention relates generally to materials separating apparatus and is concerned more particularly with separating apparatus having means for segregating nonferromagnetic metals from commingled materials.

Solid municipal waste may be shredded and then classified into light and heavy fractions, each having therein items suitable for recycling. The light fraction, for example, usually includes paper and cardboard which may be used in the production of new paper products or may be sold as combustible fuel. The heavy fraction generally is comprised of glass, ceramic, wood, ferromagnetic materials, and nonferromagnetic metals, for examples. The ferromagnetic materials may be extracted by conventional means, such as electromagnets, for example, and used in the manufacture of steel and other metal alloys.

The heavy fraction of municipal waste also includes at least two other categories of potentially saleable items, namely nonferromagnetic metals and clean glass. The nonferromagnetic component of the heavy fraction generally is comprised of aluminum scrap, copper-zinc base scrap, and tin scrap, for examples. Market analysis indicates that there is a greater demand for the nonferromagnetic metals than for other components of the heavy fraction. Thus, although constituting only about one percent by weight of typical municipal waste, the nonferromagnetic metals nevertheless represent a significant percentage of the total resale value.

Accordingly, prior art means have been developed for separating nonferromagnetic metals from other components of municipal waste. These prior art means generally involve heavy media separation, electrostatic separation, or electromagnetic separation. However, heavy media separation has not been generally satisfactory due to fluids becoming entrapped in the crushed items of municipal waste and erratically affecting their specific gravities. Electrostatic separation generally requires the use of complicated apparatus for establishing a strong electrostatic field which induces electrostatic charges on respective items of municipal waste. Electromagnetic separation generally involves the use of sophisticated electrical equipment and circuitry for producing a time varying electromagnetic field which induces eddycurrents in the nonferromagnetic metal objects in municipal waste.

Therefore, it is advantageous and desirable to provide materials separating apparatus with simple and relatively inexpensive means for segregating the nonferromagnetic metal items in commingled waste materials.

SUMMARY OF THE INVENTION

Accordingly, this invention provides material separating apparatus comprising guide means for directing commingled nonferromagnetic materials including conductors into a stream, and steady-state magnetic means for establishing in the path of the stream an alternating series of oppositely directed magnetic fields. As a result, the stream of nonferromagnetic materials passes sequentially through the static series of oppositely directed magnetic fields thereby cutting the associated lines of magnetic flux. Consequently, the conductors in the stream have induced therein respective eddy-currents which cooperate with the magnetic fields to exert uniformly directed, resultant forces on the associated conductors. Each of the resultant forces has a decelerating component directed oppositely to the flow direction of the stream, and an orthogonally directed component which draws the associated conductor laterally out of the stream in a uniform direction. The respective lateral distances the conductors are drawn out of the stream provides means for sorting the conductive materials while separating them from the nonconductive materials in the stream.

A preferred embodiment comprises a ramp-type structure having a smooth inclined surface made of nonmagnetic material and operatively disposed to receive thereon a stream of nonferromagnetic materials which flows longitudinally down the inclined surface by gravitational means. Disposed beneath the surface and parallel therewith is an alternating array of north and south magnetic pole pieces, which extend transversely of the surface and at a uniform angle with the longitudinal centerline thereof. Thus, there is established on alternating series of oppositely directed, static magnetic fields through which the stream of nonferromagnetic materials flows while traveling down the inclined surface of the ramp. As a result, conductive materials are drawn laterally out of the stream, as described, while continuing to travel down the inclined surface. Accordingly, there may be disposed at the lower end of the inclined surface, a row of containers into which associated conductive materials flow due to the corresponding lateral movement imparted thereto when passing through the magnetic fields.

BRIEF DESCRIPTION OF THE DRAWINGS

For a better understanding of this invention, the following more detailed description makes reference to the accompanying drawings wherein:

FIGS. 4*a*–4*c* are respective diagrammatic views showing the operation of this invention;

FIG. 5 is a graphical view showing advantageous uses of this invention;

DESCRIPTION OF THE PREFERRED EMBODIMENT

Figure 1:
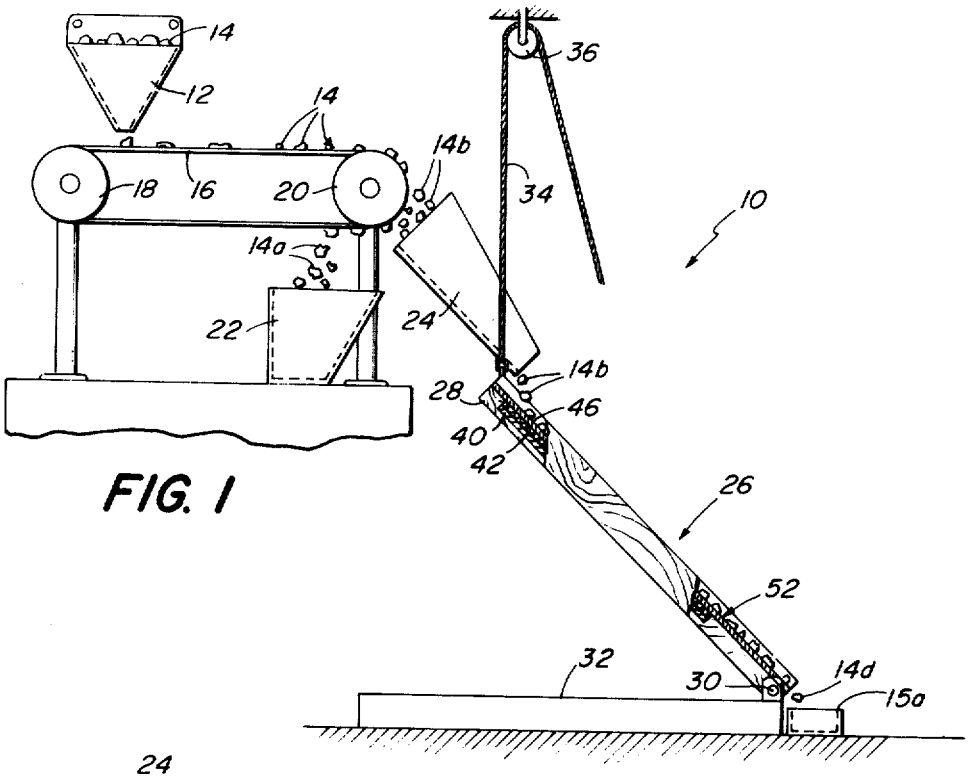
FIG. 1 is a pictorial view of a materials separating apparatus embodying this invention.

Referring to the drawings wherein like characters of reference designate like parts throughout the several views, there is shown in FIG. 1 a materials separating apparatus 10 including a funnel-shaped hopper 12. The hopper 12 is disposed to receive therein shredded waste material 14 and to feed it steadily onto a continuous conveyor belt 16. Belt 16 is made of pliable nonmagnetic material, such as a conventional sander belt, for example, and is moved longitudinally past the output end of hopper 12 by a supporting pair of spaced rotatable drums, 18 and 20, respectively. The stream of waste material 14, thus formed, on belt 16 is conveyed by the belt toward the rotatable drum 20.

The outer cylindrical surface of drum 20 may be suitably magnetized, in a well-known manner, for attracting and holding ferromagnetic items 14*a* of the waste material on engaged portions of the belt 16. Accordingly, the ferromagnetic items 14a are carried by belt 16 around the drum 20 and dropped by gravitational means into a suitably disposed container 22. Thus, ferromagnetic items 14*a* are removed from the stream of waste material 14; and the nonferromagnetic items 14*b*, after passing over drum 20, are directed onto an inclined chute 24. The chute 24 is made of suitable material, such as stainless steel, for example, and has an output end disposed to direct the resulting streamd of nonferromagnetic items 14*b* onto a ramp structure 26.

The ramp structure 26 comprises an inclined support panel 28 made of nonmagnetic material, such as wood, for example, and having a lower transverse end portion pivotally attached, as by pintle 30, for example, to a base support frame 32. Frame 32 is made of suitable material, such as wood, for example, and may have a conventional configuration, such as rectangular, for example. The support panel 28 may be rotated about the pintle 30 by any convenient means, such as rope 34 threaded through an overhanging pulley 36 and having an end fixedly attached to the upper end portion of panel 28, for example. Thus, the rope 34 and pulley 36 provide means for disposing the panel 28 at any desired angle of inclination with respect to the vertical, such as 45°, for example.

Figure 2:
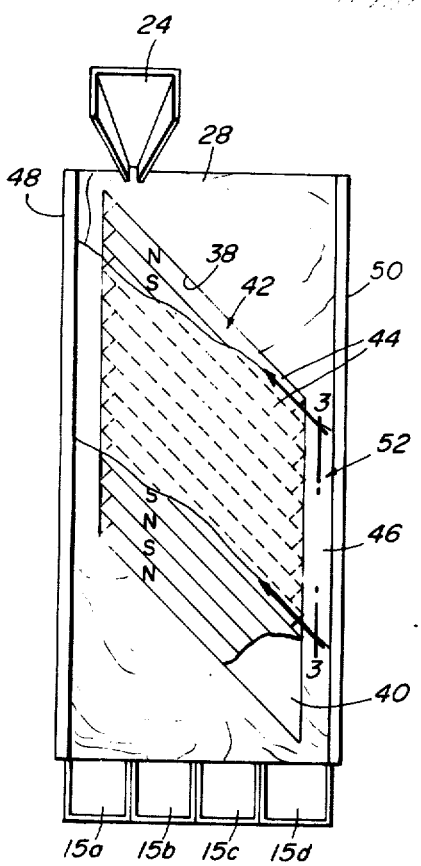
FIG. 2 is a plan view of the ramp-type separator shown in FIG. 1.

As shown more clearly in FIG. 2, the output end of chute 24 extends slightly over the upper end of panel 28 and adjacent a longitudinal side thereof. Disposed in the upper surface of panel 28 is a recess 38 which may have any desired configuration, such as a parallelogram, for example, having transverse ends disposed at a predetermined angle with respect to the longitudinal center line of panel 28. Recess 38 may be cut, in a well-known manner, into the upper surface of panel 28, or may be formed by affixing suitably configured pieces of molding to marginal portions of the panel 28. The bottom surface of recess 38, preferably, is lined with a sheet 40 of low magnetic reluctance material, such as mild steel, for example. Overlaying the sheet 40 is an alternating array 42 of oppositely polarized magnets 44 which extend transversely of the panel 28 and at a substantially uniform angle, such as 45°, for example, with respect to the longitudinal centerline thereof.

Figure 3:
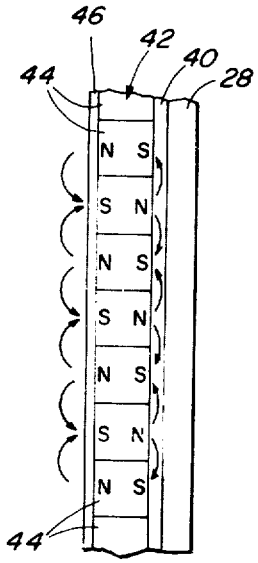
FIG. 3 is a fragmentary cross-sectional view taken along line 303 in FIG. 2 and looking in the direction of the arrows.

As shown in FIG. 3, the magnets 44 have respective magnetic poles disposed adjacent the sheet 40 and are magnetically coupled thereto. Thus, the array 42 may comprise, for example, a plurality of bar-type permanent magnets 44 which are disposed in side-by-side contiguous relationship and substantially fill the recess 38. The upper surface of array 42, preferably, is substantially flush with the upper surface of panel 28. Accordingly, the magnets 44 may be provided with substantially uniform thicknesses which determine the required depth of recess 38. Overlying the upper surfaces of array 42 and panel 28 is a smooth surface layer 46 of nonmagnetic material, which may be comprised of a thin sheet of austenitic steel, for example. The surface layer 46 is disposed between longitudinal guide members, 48 and 50, respectively, which are made of suitable material, such as wood, for example. Surface layer 46 and the guide members 48 and 50 are fastened by conventional means to respective underlying portions of the panel 28.

Thus, support panel 28 and surface layer 46 constitute an inclined plane 52 having a low friction surface down which nonferromagnetic items 14*b* streaming from chute 24 slide by gravitational means. In FIG. 3, it can be seen that adjacent the surface layer 46 the magnets 44 provide an alternating array of north and south magnetic poles which establish along the layer 46 a sequentially alternating series of oppositely directed, static magnetic fields. Extending from any particular north magnetic pole of the array are flux lines which bend upwardly of the sloped surface layer 46 and other flux lines which bend downwardly thereof to enter respective adjacent south magnetic poles on either side of the source magnet 44. Accordingly, between any three adjacent magnetic poles of the array, there is established a sequential pair of oppositely directed magnetic fields, which extend transversely of the layer 46 and at a substantially uniform angle with respect to the longitudinal centerline thereof. The lines of magnetic flux associated with the alternating series of oppositely directed magnetic fields extend above the surface layer 46 and are cut by the nonferromagnetic items 14*b* of waste material sliding down the upper surface thereof.

As shown in FIGS. 4A and 4B, a conductive item 14*c* of nonferromagnetic material, such as aluminum, for example, will slide down the inclined plane 52 with a velocity represented by vector *v* which is directed longitudinally parallel with the sloped surface layer 46. For purposes of simplicity it may be assumed that the item 14*c* is a ring with a diameter that is substantially smaller than the width of any magnet 44. It is well known that the voltage induced in such a ring is equal to the rate of change of the magnetic flux enclosed by it. Thus the maximum voltage occurs when the item 14*c* is crossing the interfacing boundary between adjacent magnets 44. By the same token the voltage is zero when the item 14*c* is exactly over the longitudinal centerline of any particular magnet 44.

The current induced in the ring is proportional to the voltage and substantially in phase with it. When the item 14*c* is passing sequentially from the region over a south magnetic to a region over a north magnetic pole, as shown in FIG. 4A, there is induced in the conductive item 14*c* a clockwise eddycurrent designated by curled vector $J_1$ in the plane of the drawing. As a result, there is exerted on the item 14c, a force designated as $F_1$ which is in the plane of the drawing and directed substantially perpendicular to the magnets 44. However, this force $F_1$ can be resolved into two components, one designated as $F_d$ which is directed longitudinally upward of the sloped surface layer 46 and substantially parallel thereto. The other component, which is designated as $F_h$, is directed perpendicular to the component $F_d$ and parallel to the surface layer 46.

Similarly, when the item 14*c* is passing sequentially from the region over a north magnetic pole to a region over a south magnetic pole, as shown in FIG. 4B, there is induced in the conductive item 14*c* a counterclockwise eddy-current designated by curled vector $J_2$ in the plane of the drawing. As a result, there is exerted on the item 14*c*, a force designated as $F_2$ which also is in the plane of the drawing and directed substantially perpendicular to the magnets 44. Consequently, the force $F_2$ may be resolved into two components, one designated as $F_d$ which is directed longitudinally upward of the sloped surface layer 46 and substantially parallel thereto, just as the equivalent component $F_d$ shown in FIG. 4A. Also, the other component, which is designated as $F_h$ is directed perpendicular to the component $F_d$ and parallel to the surface layer 46, similar to the equivalent component $F_h$ shown in FIG. 4A.

The respective components $F_d$ of forces $F_1$ and $F_2$ may be referred to as decelerating components since they are directed oppositely to the vector v. However, the decelerating components of forces $F_1$ and $F_2$, respectively, are insignificant in comparison to the force of gravity acting on the item 14*c*. However, the respective components $F_h$ of the forces $F_1$ and $F_2$ are significant, since they act sequentially in a uniform direction to move the item 14*c* laterally out of the stream of nonferromagnetic materials.

Thus, as shown in FIG. 4*c*, nonconductive items 14*d* of nonferromagnetic material do not have eddy-currents induced therein and, consequently, are not deflected from a generally rectilinear path designated by the dashed line 54. On the other hand, the conductive items 14*c* of nonferromagnetic material have eddycurrents induced therein in accordance with the conductivity of the material. Consequently, these conductive items 14*c* are subjected to a corresponding force having a laterally directed component, as described, which causes the items 14*c* to move transversely of the surface layer 46 while continuing to travel longitudinally thereof, as shown by the solid line 56. It has been found that a particular conductive item 14*c* is deflected a lateral distance proportional to the ratio of its electrical conductivity to its mass density.

In FIG. 5, there is shown a graph of a curve 58 which illustrates the relationship of lateral deflection and the width dimension 2*b* of an elongated, nonferromagnetic conductor 14*e* sliding longitudinally, as described, over an array of north and south magnetic poles having a magnetic period λ. The curve shown in FIG. 5 applies primarily to an elongated, flat piece of conductive material, but similar curves apply to other sample shapes such as flat circular discs, for example. The lower sloped portion of curve 58 indicates that when the width dimension 2*b* is much smaller than the magnetic period λ, the deflection varies as the square of the width dimension 2b. Thus, the materials separator of this invention provides means for sorting objects, such as coins, for example, which are made of similar materials but which differ in size.

The upper plateau portion of curve 58 indicates that lateral deflection approaches a limiting value when the width dimension 2*b* is much larger than the magnetic period. Accordingly, the deflection becomes substantially independent of the size of conductor 14*e*. Thus, the materials separator of this invention provides means not only for separating nonferromagnetic conductors from nonconductive materials, but also for sorting the conductive materials from one another. Since the respective conductive materials are deflected characteristic lateral distances, they may be separately collected.

Therefore, as shown in FIGS. 2 and 4, there may be disposed adjacent the lower transverse end of ramp structure 26 a parallel row of open containers, such as 15*a*–15*d*, for example, each of which is aligned with a respective longitudinal portion of the surface layer 46. The nonconductive items 14*d* of nonferromagnetic material, as previously described, will follow the path of dashed line 54 and, consequently, will enter the aligned container 15*a*. On the other hand, the nonferromagnetic conductors, such as 14*c* and 14*e*, for examples, will be deflected respective lateral distances while traveling down the sloped surface of layer 46. Accordingly, the nonferromagnetic conductors will enter associated containers 15*b*–15*d*, respectively, whereby they may be separately collected.

Figure 6:
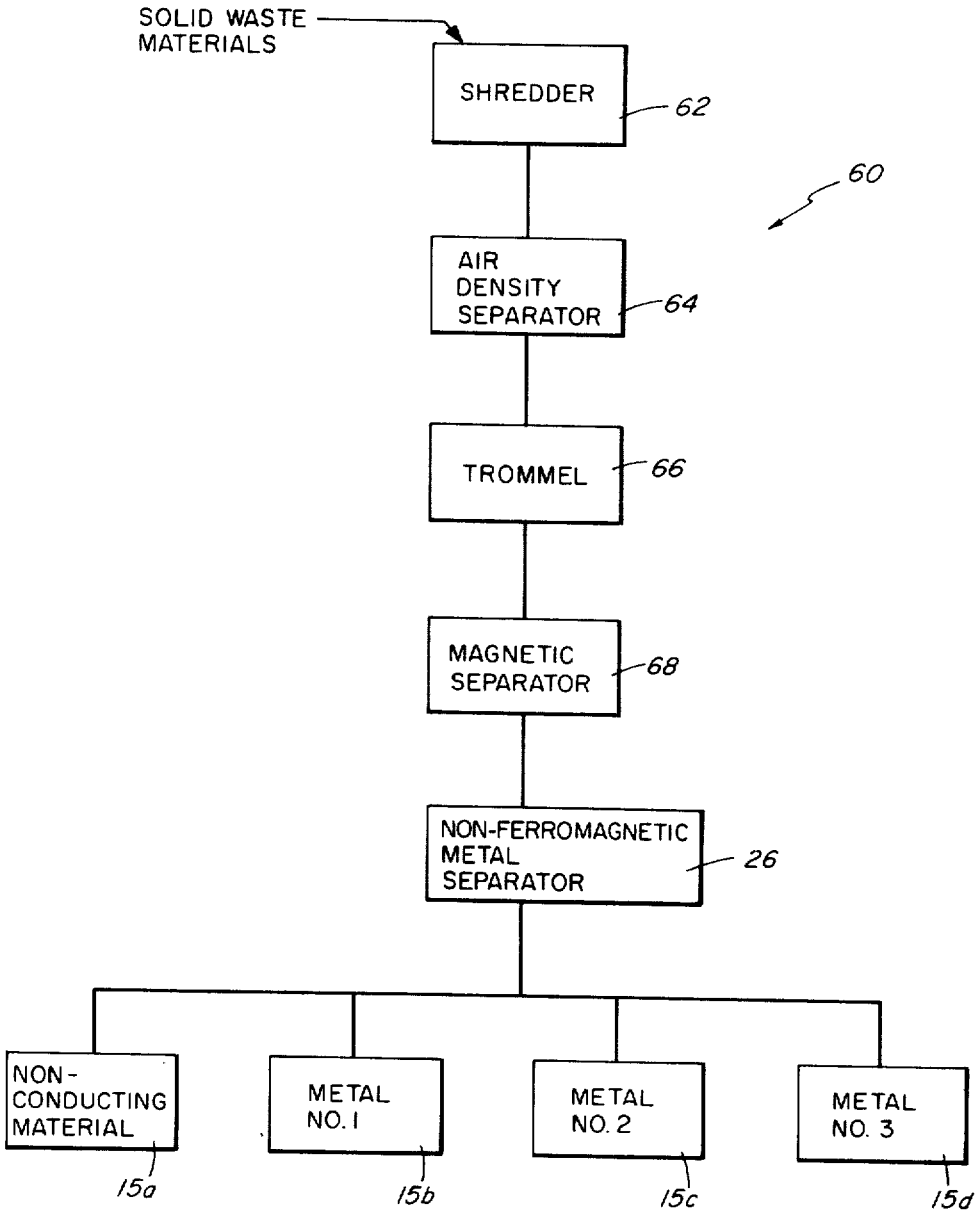
FIG. 6 is a block diagrammatic view of a typical waste materials separating system having this invention incorporated therein.

Thus, the materials separator of this invention, as shown in FIG. 6, may be embodied in a municipal waste separating system 60, for example. Raw waste material usually is introduced into a conventional shredder 62, such as a hammer mill, for example, where it is reduced to smaller and more manageable particles. These particles then may be conveyed to an air density separator 64 of the conventional type, which generally comprises a substantially upright conduit having baffling therein. Air is blown through the conduit with sufficient force to cause light fraction particles, such as paper, for example, to rise up the conduit where they are collected. The heavy fraction particles drop into a container at the bottom of the conduit where they may be collected and fed through a conventional trommel 66. The trommel 66 may comprise, for example, a rotating cylinder having mesh walls through which dust and small pieces of glass are removed from the heavy fraction of the municipal waste material.

The heavy fraction passed through trommel 66 then may be fed into a magnetic separator 68 which removes ferromagnetic items from the waste material. For example, the heavy fraction from trommel 66 may be fed into hopper 12 shown in FIG. 1. The ferromagnetic items 14*a* may be removed from the waste material by rotating drum 20, which constitutes a magnetic head roller. The nonferromagnetic items 14b then are conveyed to the ramp structure 26 of this invention which separates the nonferromagnetic conductors from the nonconductive material, as described. The component nonferromagnetic conductors, such as 14*c* and 14*e*, for examples, are collected in containers 15*b*–15*d*. The nonconductive items 14*d* of the nonferromagnetic material collected in container 15*a* may be further processed to separate therefrom other components, such as large pieces of glass, for example, which may be further sorted, such as into various colored glass items, for example.

The magnitude of the lateral deflection imparted to an electrically conductive item, such as 14*e*, for example, depends upon its initial sliding velocity, the length and inclination of inclined plane 52, and its coefficient of sliding friction with respect to surface layer 46. If the steepness of the inclined plane 52 is decreased (or the angle of inclination with respect to the vertical is increased) the sliding velocity of the item 14e is decreased correspondingly. However, the lateral deflection of item 14e may be increased considerably, such as fifty percent, for example. Thus, when the stream of nonferromagnetic materials 14 comprises many items 14e having a particular coefficient of sliding friction, the inclined plane 52 may be disposed, as by rope 34 and pulley 36, for example, at an optimal angle of inclination where lateral deflection is maximal for these items.

On the other hand, the handling of waste material, such as in system 60, for example, involves a stream of nonferromagnetic items 14*b* having various coefficients of sliding friction with the surface layer 46. In this instance, the inclined plane 52 is disposed at the optimal angle of inclination, such as forty-five degrees, for example, in order to obtain a steady flow of items 14*b* down the inclined surface, as described, and to achieve the maximum lateral deflection possible under the circumstances. Thus, it may be seen that inclined plane 52, rope 34, and pulley 36 constitute a control means for moving the nonferromagnetic items 14 as desired through the alternating series of oppositely directed fields established by array 42.

Although the array 42 of magnets 44 has been shown herein as underlying substantially the entire length of surface layer 46, it may advantageously underlie only a preselected portion of layer 46, such as the longitudinal half aligned with chute 24, for example. Alternatively, the array 42 may underlie an upper end portion of layer 46 whereby the nonferromagnetic conductors would be deflected laterally with sufficient characteristic momentum to continue separating, as described, from the stream of nonferromagnetic items 14*b* while sliding down the inclined plane 52. In the described alternative embodiments, the array 42, nevertheless, comprises a plurality of alternating oppositely polarized magnets disposed transversely with respect to the inclined plane 52 and at a uniform angle with the longitudinal centerline thereof. The uniform angle may have any desired value, such as the value at which optimal lateral deflection is achieved for nonferromagnetic items of electrically conductive materials generally found in automobile scrap, for example.

From the foregoing, it may be seen that each of the bartype magnets 44 need not be continuous, but may be comprised of respective segments disposed adjacent one another to function as described. For example, a respective bar-type magnet 44 may be formed of longitudinal segments laid end-to-end to provide a uniform magnetic pole adjacent the sheet 40 and a uniform opposite magnetic pole adjacent the surface layer 46.

Also, it may be seen that adjacent oppositely polarized magnets 44 of the array 44 may comprise respective legs of an elongated horseshoe-type permanent magnet. When the entire array 42 is comprised of a plurality of such elongated horseshoetype magnets, the low reluctance sheet 40 may be eliminated since the closed ends of the respective magnets provide return paths for the associated magnetic flux.

Furthermore, the magnets 44 need not be of the permanent type, but alternatively may be of the electromagnetic type, provided that the respective energizing coils of the electromagnets are suitably connected to a source of unidirectional current. However, for energy conserving purposes, permanent magnets may be preferable to electromagnets, since the former do not require electrical energy for their operation. Thus, an alternating series of oppositely directed magnetic fields established by an array 42 of permanent magnets 44, and a ramp structure 26 using the force of gravity to move a stream of nonferromagnetic materials sequentially through the magnetic fields, as described, provides means for conserving the maximum amount of energy while separating conductors from the stream.

Although the surface layer 46 has been illustrated herein as a thin layer of nonmagnetic metal, it may equally well be made of smooth surfaced, dielectric material, such as polytetrafluorethylene, for example. However, the layer 46 should be maintained as thin as possible since the magnetic field strengths decrease rapidly with the distance from the magnets 44. Therefore, the magnets 44 may advantageously be embedded in the smooth surfaced, dielectric layer. Alternatively, the array 42 may be supported above the surface layer 46 and in spaced opposing relationship therewith. In this instance, the surface layer 46 may advantageously be made of magnetic material, such as mild steel, for example.

Also, from the foregoing, it may be seen that means other than the ramp structure 26 may be used for moving the stream of nonferromagnetic materials sequentially through the alternating series of oppositely directed magnetic fields. For example, the inclined plane 52 may be replaced by an upright wall having a surface adjacent which the array 42 of magnets 44 is disposed, and along which the nonferromagnetic items 14b are allowed to fall. Alternatively, the surface layer 46 may comprise a conveyor belt which carries the stream of nonferromagnetic materials through the series of oppositely directed magnetic fields, for example. Also, the array 42 of magnets 44 may be disposed, as described, with respect to a stationary surface having thereon a stream of nonferromagnetic materials; and the array 42 may be moved relative to the stationary surface. Thus, any convenient means may be used to move the stream of nonferromagnetic materials through the angularly disposed series of oppositely directed magnetic fields.

Figure 7:
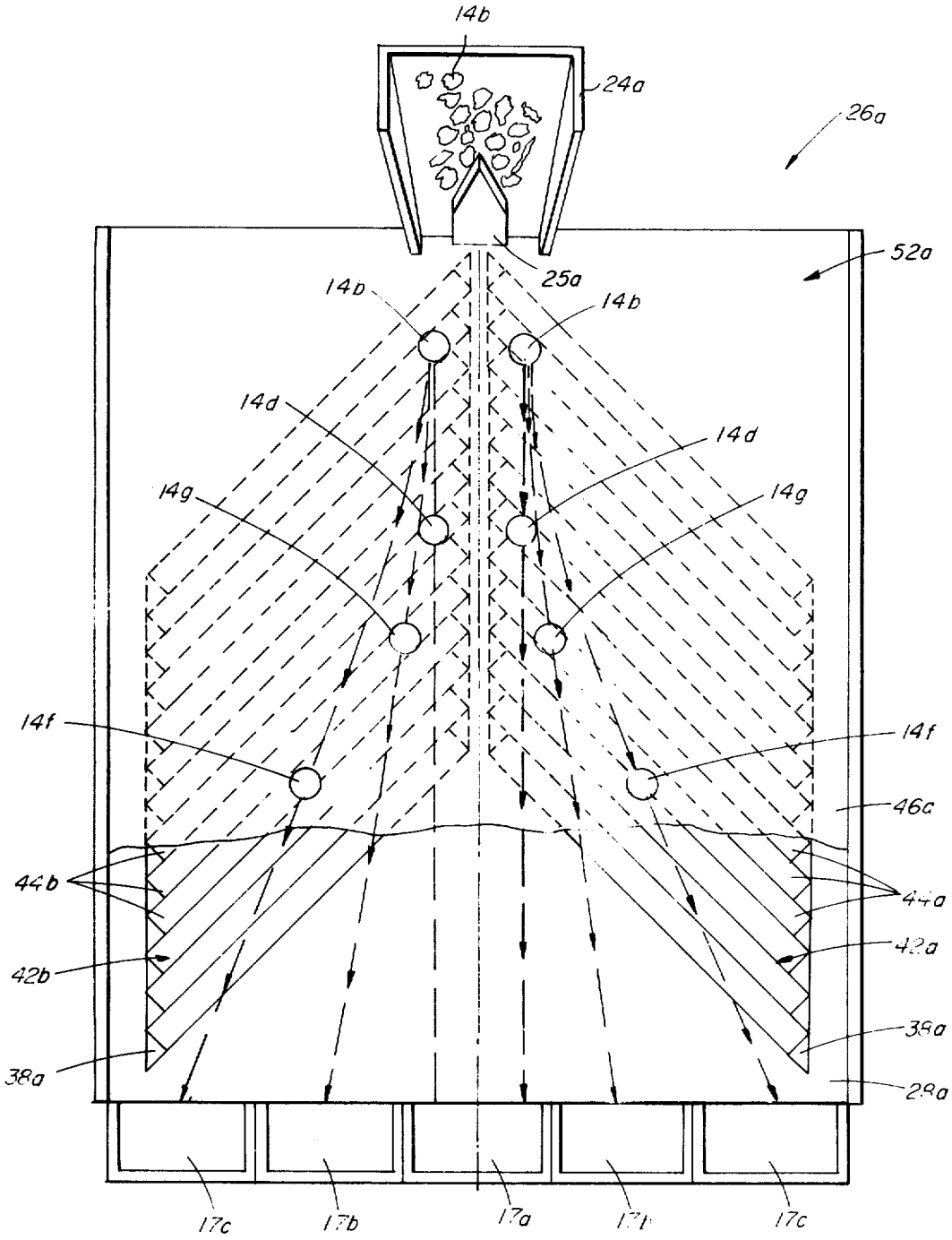
FIG. 7 is a plan view of an alternative embodiment of the ramp-type separator shown in FIG. 2.

As shown in FIG. 7, an alternative embodiment of this invention may comprise a dual ramp structure 26*a* including a low friction surface layer 46*a* overlying a pivotally mounted support panel 28*a*, such as shown in FIG. 1, for example. The surface layer 46*a* and support panel 28*a* are made of appropriate nonmagnetic materials, and constitute an inclined plane 52*a* which is positionable at a desired angle with respect to the vertical. Support panel 28*a* is provided with suitable means, such as respective recesses 38*a*, for example, for supporting beneath the surface layer 46*a* and substantially parallel therewith, a longitudinally extending pair of juxtaposed magnetic arrays 42*a* and 42*b*, respectively. Each of the respective arrays 42*a* and 42*b* comprises a parallel series of alternating oppositely polarized magnets, 44*a* and 44*b*, respectively, which extend transversely of the inclined plane 52*a* at a substantially uniform angle with the longitudinal centerline thereof. However, corresponding magnets 44a and 44b of the arrays 42*a* and 42*b*, respectively, are disposed in reverse angulated relationship with respect to the longitudinal centerline of plane 52*a*. Consequently, above the surface layer 46*a*, each of the respective arrays 42*a* and 42*b* establishes a spatially alternating series of oppositely directed, static magnetic fields which, in combination, form a herringbone pattern along the slope of inclined plane 52*a*. As a result, one longitudinal half of the ramp structure 26*a* constitutes a mirror image of the other longitudinal half; and each half functions in a manner similar to the ramp structure 26 shown in FIG. 2. Thus, it may be seen that the dual ramp structure 26*a* has a materials handling capacity double that of the ramp structure 26.

Accordingly, at the upper end of ramp structure 26*a*, a chute 24*a* may be suitably disposed for directing a stream 14*b* of commingled nonferromagnetic items onto surface layer 46*a* and adjacent the longitudinal centerline of plane 52*a*. The chute 24*a* preferably is provided with a stream splitter 25*a* which divides the stream 14*b* and directs the resulting portions thereof onto respective longitudinal portions of the inclined plane 52*a*. Consequently, the items in each portion of stream 14*b* are carried by gravitational means down the slope of the respective longitudinal portion of plane 52*a*, and pass sequentially through the associated spatially alternating series of oppositely directed, static magnetic fields.

As previously described, nonconductive items, such as 14*d*, for example, do not have eddy currents induced therein and, therefore, follow a generally rectilinear path down the slope of inclined plane 52*a*. However, conductive items, such as 14*f* and 14*g*, for examples, do have eddy currents induced therein and, consequently, are deflected laterally while continuing to travel longitudinally down the slope of inclined plane 52*a*. The plane 52*a* may be disposed, as previously described, at an optimum angle of inclination with respect to the vertical for achieving maximum deflection of items made of a desired material, such as aluminum, for example, while maintaining a smooth flow of nonferromagnetic materials down the ramp structure 26*a*. Thus, items made of the desired material, such as 14*f*, for example, may be deflected greater lateral distances than other conductive items, such as 14*g*, for example.

Accordingly, at the lower end of ramp structure 26*a*, there may be disposed a parallel row of open containers, such as 17*a* – 17*c*, for examples. The container 17*a* is disposed substantially in alignment with a longitudinal central portion of inclined plane 52*a* to receive the items 14*d* of nonconductive material, which may be referred to as the "tailings". The two containers 17*c* are disposed substantially in alignment with respective longitudinal outer marginal portions of the inclined plane 52*a* to receive the items 14*f* of desired conductive material, which may be referred to as the "headings". Between the container 17*a* and the containers 17*c* are disposed resective containers 17*b* which are substantially aligned with central regions of the associated longitudinal portions of inclined plane 52*a*. The containers 17*b* receive other conductive items 14*g*, and items 14*f* of desired material which were not deflected sufficient lateral distances for various reasons, such as interference with items 14*g*, for example. The material received by containers 17*b*, which may be referred to as the middlings, generally is recycled through a materials separator, such as ramp structure 26*a*, for example, to recover the items 14*f* of desired material therefrom.

From the foregoing, it will be apparent that all of the objectives of this invention have been achieved by the structures shown and described. It also will be apparent, however, that various changes may be made by those skilled in the art without departing from the spirit of the invention as expressed in the appended claims. It is to be understood, therefore, that all matter shown and described herein is to be interpreted as illustrative and not in any limiting sense.

It is claimed that:

1. Materials separating apparatus for sorting commingled ferromagnetic and nonferromagnetic materials including electrically conductive items of nonferromagnetic material, and comprising:

magnetic separator means for segregating the ferromagnetic materials from the nonferromagnetic materials;

guide means disposed adjacent the magnetic separator means for directing the nonferromagnetic materials downwardly into a stream;

steady-state magnetic means disposed to establish at least one alternating series of oppositely directed and substantially parallel magnetic fields transversely at an oblique angle to the stream for inducing eddy currents in the electrically conductive items and producing force components which deflect the items out of the stream; and control means coupled to the guide means and the steady-state magnetic means for passing the nonferromagetic materials sequentially through the magnetic fields.

2. Materials separating apparatus as set forth in claim 1 wherein the steady-state magnetic means includes an alternating array of north and south magnetic pole pieces disposed adjacent the stream.

3. Materials separating apparatus as set forth in claim 2 wherein the array comprises a plurality of bar magnets disposed in substantially parallel relationship with one another.

4. Materials separating apparatus as set forth in claim 2 wherein the array includes a plurality of longitudinal portions, each of which comprises a plurality of substantially parallel magnets disposed at a respective oblique angle to the stream.

5. Materials separating apparatus as set forth in claim 4 wherein the array includes two longitudinal portions, the respective magnets of which are disposed in reverse angulated relationship with respect to the stream.

6. Materials separating apparatus as set forth in claim 5 wherein one longitudinal half of the array constitutes a mirror image of the other longitudinal half thereof.

7. Materials separating apparatus as set forth in claim 6 wherein said alternating series of oppositely directed magnetic fields are established in a herringbone pattern along the stream.

8. Materials separating apparatus as set forth in claim 1 wherein the control means includes support means operatively disposed with respect to the guide means and the steady-state magnetic means for conducting the stream of nonferromagnetic materials from the guide means and angularly through the magnetic fields.

9. Materials separating apparatus as set forth in claim 8 wherein the support means includes an elongated inclined plane and adjusting means operatively coupled thereto for varying the angle of inclination of the inclined plane with respect to the vertical.

10. Materials separating apparatus as set forth in claim 9 wherein the inclined plane includes friction minimizing surface means for sliding the stream of nonferromagnetic material sequentially through the magnetic fields.

11. Material separating apparatus as set forth in claim 10 wherein the steady-state magnetic means includes an alternating array of north and south magnetic pole pieces disposed adjacent the inclined plane.

12. Material separating apparatus as set forth in claim 11 wherein the array includes a plurality of substantially parallel magnets disposed at an oblique angle to the longitudinal centerline of the inclined plane.

13. Materials separating apparatus as set forth in claim 11 wherein the array includes a plurality of longitudinal portions, each of which comprises a plurality of substantially parallel magnets disposed at a respective oblique angle to the longitudinal centerline of the inclined plane.

14. Materials separating apparatus as set forth in claim 13 wherein the array comprises two longitudinal portions, the respective magnets of which are disposed in reverse angulated relationship with respect to the longitudinal centerline of the inclined plane.

15. Materials separating apparatus as set forth in claim 14 wherein one longitudinal half of the array constitutes a mirror image of the other longitudinal half thereof.

16. Materials separating apparatus as set forth in claim 15 wherein said alternating series of oppositely directed magnetic fields are established in a herringbone pattern along the longitudinal centerline of the inclined plane.

17. Materials separating apparatus for sorting commingled waste materials including ferromagnetic materials and metallic items of nonferromagnetic material, the apparatus comprising:

guide means for directing commingled waste materials downwardly into a stream;

magnetic attracting means operatively coupled to the stream for removing ferromagnetic materials therefrom and converting it to a stream of nonferromagnetic materials;

conducting means operatively disposed with respect to the magnetic attracting means for receiving therefrom the stream of nonferromagnetic materials and directing it along a predetermined path; and steady-state magnetic means operatively coupled to the path for establishing transversely at an oblique angle thereto at least one spatially alternating series of oppositely directed, substantially parallel magnetic fields and inducing eddy currents in metallic items of nonferromagnetic material in the stream, the eddy currents and associated magnetic fields producing force component means for deflecting the items laterally out of the stream.

18. Materials separating apparatus as set forth in claim 17 wherein the conducting means includes an elongated inclined plane having slidable surface means for directing the stream of nonferromagnetic materials along a portion of the predetermined path.

19. Materials separating apparatus as set forth in claim 18 wherein the steady-state magnetic means includes an alternating array of north and south magnetic pole pieces disposed in a plane adjacent the slidable surface means and at a uniform angle to the longitudinal centerline thereof.

20. Materials separating apparatus for sorting commingled waste materials including ferromagnetic materials and nonferromagnetic electrically conductive materials, the apparatus comprising:

shredding means operatively disposed for receiving commingled waste materials and producing corresponding items of shredded waste materials;

guide means operatively disposed with respect to the shredding means for receiving the items of shredded waste materials and directing them into a stream;

magnetic attracting means operatively coupled to the stream for removing ferromagnetic items therefrom and converting it to a stream of nonferromagnetic items;

conducting means operatively disposed with respect to the magnetic attracting means for directing the stream of nonferromagnetic items along downwardly predetermined path; and steady-state magnetic means operatively coupled to the path for establishing transversely at an oblique angle thereto at least one spatially alternating series of oppositely directed static magnetic fields in substantially parallel relationship with one another and inducing eddy currents in nonferromagnetic items of electrically conductive material, the eddy currents and associated magnetic fields producing force components means for moving the items of electrically conductive material laterally out of the stream in a uniform direction.

21. Materials separating aparatus as set forth in claim 20 wherein the conducting means includes an elongated inclined plane having a slidable surface for directing the stream of nonferromagnetic items along the path; and the steady-state magnetic means includes a plurality of north and south magnetic poles disposed in an alternating planar array adjacent the slidable surface and at a uniform angle to the longitudinal centerline thereof.

22. Materials separating apparatus for sorting commingled nonferromagnetic materials including items of electrically conductive materials and comprising:

guide means for directing commingled nonferromagnetic materials downwardly into a stream;

steady-state magnetic means including at least one alternating array of substantially parallel north and south magnetic pole pieces disposed transversely an oblique angle, to the stream to establish a spatially alternating series of oppositely directed magnetic fields for inducing eddy currents in the electrically conductive items and producing force components which deflect the items out of the stream; and control means including an inclined plane disposed with respect to the guide means and the magnetic fields for conducting the stream of nonferromagnetic materials sequentially and angularly through the magnetic fields.

23. Materials separating apparatus as set forth in claim 22 wherein the control means includes adjusting means coupled to the inclined plane for varying the angle of inclination thereof with respect to the vertical.

24. Materials separating apparatus as set forth in claim 23 wherein the inclined plane includes minimized friction surface means for sliding the nonferromagnetic materials through the magnetic fields.

25. Materials separating apparatus as set forth in claim 24 wherein the inclined plane is disposed approximately at a critical angle of inclination for achieving maximal deflection of electrically conductive items having a particular coefficient of sliding friction.

26. Materials separating apparatus as set forth in claim 25 wherein the electrically conductive items are substantially smaller than the width dimension of adjacent north and south magnetic pole pieces of the array.

27. Materials separating apparatus as set forth in claim 26 wherein the electrically conductive items are made of similar materials differing in size.

28. Materials separating apparatus as set forth in claim 24 wherein the electrically conductive items are substantially larger than the width dimensions of adjacent north and south magnetic poles of the array.

* * * * *

UNITED STATES PATENT OFFICE

CERTIFICATE OF CORRECTION

Patent No. 4,003,830 Dated January 18, 1977

Inventor(s) Ernst F.R.A. Schloemann

It is certified that error appears in the above-identified patent and that said Letters Patent are hereby corrected as shown below:

In Column 2, line 26, at end of line, "on" should read -- an --.

In Column 3, line 20, "streamd" should read -- stream --.

In Claim 20, line 63, after "along" insert -- a --.

In Claim 22, line 29, before "an" insert --at--;

Signed and Sealed this

Thirty-first Day of May 1977

[SEAL]

*Attest:*

RUTH C. MASON
*Attesting Officer*

C. MARSHALL DANN
*Commissioner of Patents and Trademarks*